United States Patent [19]

Verschuur

[11] 4,015,731

[45] Apr. 5, 1977

[54] PREPARATION OF A WET LOAD OF COAL FOR TRANSPORT AND STORAGE

[75] Inventor: Eke Verschuur, Amsterdam, Netherlands

[73] Assignee: Shell Oil Company, Houston, Tex.

[22] Filed: Nov. 20, 1975

[21] Appl. No.: 633,891

Related U.S. Application Data

[62] Division of Ser. No. 513,968, Oct. 11, 1974, Pat. No. 3,957,456.

[30] Foreign Application Priority Data

Oct. 23, 1973 United Kingdom ..... 49214/73

[52] U.S. Cl. ..... 214/152; 214/14; 214/15 B

[51] Int. Cl.[2] ..... B63B 27/24

[58] Field of Search ..... 214/12, 14, 15 B, 15 R, 214/13, 152; 44/10 R, 10 E

[56] References Cited

UNITED STATES PATENTS

| | | | |
|---|---|---|---|
| 1,618,248 | 2/1927 | Walton | 44/23 |
| 2,416,476 | 2/1947 | Fuchs | 44/10 R |
| 3,606,036 | 9/1971 | Beebe | 214/14 |
| 3,606,038 | 9/1971 | Thomas | 214/15 B |

*Primary Examiner*—Robert J. Spar
*Assistant Examiner*—George F. Abraham

[57] ABSTRACT

Method for the preparation of a wet load of coal with a bulk density of at least 700 kg/m³ by preparing briquettes containing less than 10% wt water from an aqueous slurry of coal fines, such as from a pipeline, and mixing the briquettes with wet coal fines or extrudates or agglomerates thereof containing up to 30% wt water. The briquettes can be prepared by dewatering the slurry, extrudating the obtained paste and briquetting the extrudates; or by agglomerating the coal fines, for example with naphtha, and briquetting the agglomerates, for example by removal of naphtha.

2 Claims, No Drawings

PREPARATION OF A WET LOAD OF COAL FOR TRANSPORT AND STORAGE

RELATED APPLICATION

This application is a division of application Ser. No. 513,968, filed Oct. 11, 1974 and now U.S. Pat. No. 3,957,456.

BACKGROUND OF THE INVENTION

This invention relates to the preparation of a wet load of coal with a bulk density of at least 700 kg/m$^3$, especially suitable for transport and storage.

It has been proposed to transport coal from the mining site to an area of further use or to harbor facilities for further transport by ship, by crushing it to coal fines, preparing an aqueous slurry of coal fines from the crushed coal and pumping this slurry through a pipeline. One particular advantage of this "wet" route over the transport of dry coal fines is that it does not present severe dust and explosion problems.

In an aqueous slurry of coal fines the latter will remain in suspension while the slurry is pumped through a pipeline. However, if the coal is to be stored or transported by ship, a slurry is not practical because a considerable amount of water is present and the fines will not be kept suspended for any length of time. It will be clear that the storage or transport of water is cumbersome and that the need for reslurrying at the end of the storage or transport interval is not very attractive.

It is possible to store or ship the coal fines in a dry condition. However, as has been mentioned above it is expensive to completely dry the fines and cumbersome to handle the dry dust.

SUMMARY OF THE INVENTION

The present invention aims at a novel route for the transport and storage of coal that has advantage over the above-mentioned routes and more particularly the present invention proposes the preparation of a wet load of coal. It has been found that shipping or storing of coal may advantageously be done with a wet load of coal having a bulk density of at least 700 kg/m$^3$ and prepared in a special way.

A method for the preparation of a wet load of coal with a bulk density of at least 700 kg/m$^3$ according to the invention involves preparing briquettes with a dry appearance containing less than 20% by weight of water from an aqueous slurry of coal fines and subsequently mixing the briquettes with a mass of water and either coal fines or a product obtained therefrom.

DESCRIPTION OF PREFERRED EMBODIMENTS

Since briquettes prepared according to this invention contain essentially less water than the aqueous slurry from which they are prepared, the wet load of coal will also contain less water. On the other hand, since the wet load of coal also contains the mass of water and coal, it will not be in a dry state and can easily be handled without dusting.

Briquettes are understood to be compact lumps of any desired shape and dimensions.

The wet load of coal prepared by the above-mentioned method according to the invention can be stored and transported, for instance, in tankers at an attractively high bulk density, without the danger of dust formation.

According to a preferred embodiment of the invention the briquettes contain less than 15% by weight of water.

The briquettes have to be mixed with a mass of water and either coal fines or a product obtained therefrom. Such a mass may, according to the invention, be prepared from an aqueous slurry of coal fines, possibly from the slurry from which the briquettes are also made.

According to another embodiment of the invention the mass is obtained by dewatering an aqueous slurry of coal fines to a water content of less than 30% by weight.

It is also possible to prepare the mass by agglomerating the coal fines in an aqueous slurry of coal fines and by removing excess water. The agglomeration of coal fines is a known technique and can be carried out for example in a pelletizer, by adding a binder, with vigorous stirring. The pellets or agglomerates obtained may subsequently be removed from the water, for instance, on a filter. If desired, the binder may subsequently be stripped or partly stripped from the agglomerates, before the latter are added, together with the desired amount of water, to the briquettes. Other agglomerating techniques may also be used, however. One advantage of the agglomeration route is the fact that the ash content of the coal may easily be reduced thereby.

A third possible route for making the above-mentioned mass comprises dewatering an aqueous slurry of coal fines to such an extent that a paste is obtained and extruding the paste, to obtain a mass of extrudates comprising coal fines and water. An attractive feature of this route is that the extrudates can easily be mixed with the briquettes.

The water content of the mass to be added to the briquettes will generally range from 10 to 20% by weight. However, depending among other things on the amount of mass to be added to the briquettes, less or more water may be present in the mass to arrive at a desired water content and bulk density of the wet load of coal.

The briquettes are preferably prepared from the aqueous slurry of coal fines by agglomerating the coal fines with a binder, removing the agglomerates obtained from the water and briquetting the agglomerates. One way of agglomerating has been explained above. The binder can be stripped from the agglomerates before, during or after briquetting, as desired. The stripping may be carried out, for instance with steam or by heating the agglomerates. The binder may be reused for agglomeration.

A consequence of a total recycle of the binder will in general be that the obtained briquettes will contain no binder and no water, since the latter is usually also separated off. In some cases a totally dry briquette may have advantages in the wet load of coal; for example, if more of the said mass can then be mixed with the briquettes.

It is possible to use such a binder for preparing the agglomerates that a fraction of the binder can be separated from the obtained agglomerates and another fraction is left in the agglomerates. This may be accomplished, for example, by using a binder containing a light hydrocarbon oil fraction, such as naphtha, and a high-boiling product such as a heavy hydrocarbon oil fraction or a product obtained from coal. Suitable products are bitumen and coal tar. The light hydrocarbon fraction may then be stripped from the agglomerates or from the briquettes obtained therefrom.

One alternative route for making the agglomerates comprises adding an amount of light hydrocarbon binder to the aqueous coal slurry while vigorously stirring until agglomerates are formed and subsequently adding a second amount of light hydrocarbon to take up the agglomerates. A hydrocarbon phase containing the agglomerates is then separated from a water phase and the agglomerates can be separated from the excess hydrocarbon and be dried.

Briquettes can be made from coal particles by compacting a predetermined amount of coal particles in a mold. Usually, if water is still attached to the coal particles, some water will escape during the pressing in the mold. Accordingly, the briquettes can have a fairly low water content, for instance less than 15% by weight and can have a dry appearance.

For making briquettes it is in most cases preferred that the coal particles should have a particle size above that of coal fines in order to obtain briquettes of an acceptable strength and water content. Coal particles of too small a diameter do not fill the mold sufficiently and thus give rise to difficulties during briquetting.

Sometimes, however, it is yet possible to prepare briquettes from completely dry coal fines or agglomerates, i.e., containing substantially no water. Especially if a binder is used it may become possible to prepare dry briquettes.

The briquettes may alternatively also be prepared from the aqueous slurry of coal fines by dewatering the slurry to such an extent that a paste is obtained, extruding the paste and briquetting the obtained extrudates. In general, some water will escape additionally during briquetting.

Dewatering may be carried out, for example, by vaporizing part of the water contained in the aqueous coal slurry, or by thickening, centrifuging and/or filtering the slurry.

If the briquettes are mixed with a mass that is obtained by simply dewatering an aqueous slurry of coal fines to a water content of less than 30% by weight and if the briquettes are prepared from an aqueous slurry of coal fines by agglomerating the coal fines with a binder, removing the obtained agglomerates from the water and briquetting the agglomerates, then it is possible to divide an aqueous slurry into two parts, to prepare the mass from one part and to prepare the briquettes from the other part.

According to another embodiment of the invention, wherein the briquettes are mixed with a mass that is obtained by agglomerating the coal fines in an aqueous slurry of coal fines and removing excess water, and wherein the briquettes are prepared from an aqueous slurry of coal fines by agglomerating the coal fines with a binder, removing the obtained agglomerates from the water and briquetting the agglomerates, it is possible to prepare all the agglomerates from one aqueous slurry of coal fines, to briquette part of the agglomerates and to mix the briquettes then obtained with the remainder of the agglomerates.

Alternatively it is also possible to prepare a wet load of coal according to the invention by dewatering one aqueous slurry of coal fines to such an extent that a paste is obtained, extruding the paste to obtain a mass of extrudates comprising coal fines and water, briquetting part of the extrudates and mixing the obtained briquettes with the remainder of the extrudates.

The last-mentioned three embodiments of the invention are attractive routes for obtaining a wet load of coal, wherein the separate steps are integrated as far as possible. These routes are especially applicable in those instances where one type of aqueous coal slurry of constant quality is available. If, however, different types of coal slurries are available, of which some are suitably worked up to briquettes, whereas others are preferably used for preparing the mass to be mixed therewith, it is preferred to carry out the different process steps separately.

If the coal fines are to be agglomerated before they can be briquetted, it is possible to use a light hydrocarbon for that purpose. The agglomerates obtained are dried after separation from the water and the light hydrocarbon obtained in the drying step is re-used in the agglomeration step. A suitable light hydrocarbon is naphtha. Other light hydrocarbons may also be used, such as light hydrocarbons made from coal.

It might be economical in some cases to use a heavier binder and to leave the binder in the agglomerates. Strong briquettes may be obtained in this way. A suitable binder would be one obtained from coal, such as coal tar. Such a binder can be produced at the site where the wet load of coal is prepared, for instance at the harbor where the load is to be shipped.

For some applications, such as for transport by ship, the bulk density of the wet load of coal is at least 900 $kg/m^3$. Such a density is considered to be outside the range of pumpable slurries of coal fines and guarantees a good use of the storage or loading capacity available.

In some cases it is preferred, more particularly, to aim at a bulk density of from 1000 to 1200 $kg/m^3$. This is an attractive range of densities in particular for transport by ship, since the potential transport capacity of the ship that is to carry such a load can then be more efficiently utilized.

In general, the aqueous slurry of coal fines used for making the wet load of coal according to the present invention, will contain from 30 to 60% by weight of solids. The above-mentioned solids content include whose which are generally used when an aqueous slurry of coal fines is to be pumped through a pipeline.

The aqueous slurry of coal fines preferably contains solid particles of which at least 90% by weight have a particle size of below 10 mm. More particularly, the slurry may contain particles of which at least 50% by weight has a particle size of below 1 mm, according to a preferred embodiment of the invention. Especially under these conditions the invention provides a suitable method of storing or shipping coal that is otherwise not easily handled.

Of the agglomerates that are prepared according to some of the described embodiments of the invention for incorporation in the wet load of coal, at least 90% by weight preferably consist of particles with a size of above 1 mm. Suitably, at least 50% by weight of the agglomerates have a particle size of between 5 and 20 mm. Especially for the purpose of briquetting, the latter particle size is convenient.

For those embodiments of the invention according to which extrudates are prepared for incorporation in the wet load of coal, it is preferred that at least 90% by weight of the extrudates have a particle size exceeding 1 mm. For further briquetting of these extrudates, this is a practical particle size since the particles behave well in the briquetting mold and during transport thereto. Although in view of the purely controlled operation of the extrusion process, the extrudates will in principle all have substantially equal diameters, it may be advantageously to prepare two or more types of extrudates of different particle size in order to ultimately arrive at briquettes of higher density. The extrudates will then fill the briquetting mold more or less in closest packing. The same applies to the extrudates that are used as the said mass to be mixed with the briquettes.

The briquettes prepared by a method according to the invention may have a smallest dimension of at least 5 mm. The briquettes will generally have substantially equal dimensions as predetermined by the briquetting molds. In some instances it will be preferred to have at least two types of briquettes of different size, in order to ultimately arrive at a wet load of higher density.

According to the invention, moreover, a method is proposed for transporting coal by ship, in which the ship is loaded with a wet load of coal prepared by one of the above-mentioned methods according to the invention. The aqueous coal slurry used for the purpose of the latter methods may, for example, be withdrawn from a pipeline. Accordingly, an attractive route for the transport of coal is obtained, whereby the coal fines are slurried in water and pumped through a pipeline to a harbour and whereby the aqueous slurry of coal fines is transported into a wet load of coal at the harbor and loaded in a ship.

It should be noted that the wet load of coal as prepared by a method according to the invention may be loaded in a ship for transport and that at the end of the journey the load may be separated into two or more products, such as briquettes on the one hand and a mass of wet coal fines on the other. The different products might well be used for different purposes.

The invention will be further elucidated by the following examples.

EXAMPLE I

A coal slurry containing 41% by volume of coal fines having a specific gravity of 1452 kg/m$^3$, was filtered at 0.7 kg/cm$^2$ differential pressure. The filter cake obtained contained 15.4% by weight of water and 754 kg dry coal per m$^3$ under a load of 1 kg/cm$^2$.

A portion of about 40% of the filter cake was processed in a briquetting machine at a pressure of 500 to 1000 kg/cm$^2$, resulting in briquettes containing 90.5% by volume of coal.

The briquettes were subsequently mixed with the remainder of the filter cake. The latter crumbled during mixing. A non-dusting load of coal was obtained containing 967 kg dry coal per m$^3$ under a load of 1 kg/cm$^2$.

EXAMPLE II

A coal slurry containing 49% by volume of coal fines, having a specific gravity of 1307 kg/m$^3$ was filtered at 9.7 kg/cm$^2$ differential pressure. The filter cake obtained contained 29.3% by weight of water and 676 kg dry coal per m$^3$ under a load of 1 kg/cm$^2$.

A portion of about 50% of the filter cake was processed in a briquetting machine at a pressure of 500 to 1000 kg/cm$^2$, resulting in briquettes containing 84.7% by volume of coal.

The briquettes were subsequently mixed with the remainder of the filter coal. The non-dusting load of coal thus obtained contained 865 kg dry coal per m$^3$ under a load of 1 kg/cm$^2$.

EXAMPLE III

A coal slurry containing 60% by volume of coal fines, which coal fines had a specific gravity of 1447 kg/m$^3$, was dewatered by pelletization of the fines and thermal drying of the pellets obtained. The cohesive powder thus obtained contained 19.3% by weight of water and of 754 kg dry coal per m$^3$ under a load of 1 kg/cm$^2$.

A portion of about 50% of the powder was processed in a briquetting machine at a pressure of 500 to 1000 kg/cm$^2$, resulting in briquettes containing 84.8% by volume of coal. The briquettes were subsequently mixed with the remainder of the powder giving a wet load of coal containing under a load of 1 kg/cm$^2$ 1021 kg dry coal per m$^3$.

EXAMPLE IV

A coal slurry, containing 49% by volume of coal fines, was filtered, giving a filter cake that contained 20% by weight of water and 676 kg dry coal per m$^3$ under a load of 1 kg/cm$^2$.

The cake was extruded and about 50% of the extrudates obtained were fed to a briquetting machine. Briquetting reduced the water content of the coal to 12% by weight. The coal volume concentration in the extrudates was 62%, the same concentration in the briquettes being 85%.

The briquettes obtained were mixed with the remainder of the extrudates. The load of coal thus obtained was stored and at a depth of 20 meters the coal contained 1090 kg dry coal per m$^3$ by compaction under the own weight.

EXAMPLE V

An amount of about 25% of a coal slurry containing 49% by volume of coal fines was fed to a pelletizer, wherein the coal fines were pelletized with naphtha. The obtained pellets were removed from the water phase with the aid of a sieve and subsequently stripped with 140° C steam to remove all of the water and the naphtha. In this way a mass of partially intact and partially crushed pellets was obtained.

The remaining 75% of the slurry was dewatered mechanically by centrifuging the mass obtained, having a free-moisture content of 15.8% by weight. About two thirds of the mass was then thermally dried to a 0% free-moisture content and subsequently briquetted in a briquetting machine.

The resulting briquettes were then mixed with the remainder of the mass of dewatered slurry and with the mass of pellets, giving a wet load with a bulk density of 960 kg/m$^3$. The coal in this load had an average specific gravity of 1390 kg/m$^3$.

EXAMPLE VI

A amount of about 40% of a pipeline slurry, which slurry contained 49% by volume of coal fines, was fed to a pelletizer. The coal fines were pelletized with a mixture of 80% by weight of naphtha and 20% by weight of bitumen. This mixture was used in an amount of 21% by weight relative to the amount of coal fines.

The resulting pellets were separated from the water phase on a sieve and dried. Subsequently the naphtha was stripped off. The pellets obtained only contained bitumin as a permanent binder. They were compacted in a briquetting machine to strong, dry and waterresistant briquettes of a uniform size of about 7 cm diameter.

Due to the pelletization step the briquettes proved to contain as little as 8% by weight of ash, whereas the coal fines in the pipeline slurry contained 12% by weight of ash. The ash is retained to some extent in the water phase during pelletization.

An amount of 30% of the above pipeline slurry was thermally dried until a mass with a moisture content of 8% by weight was obtained. The mass was compacted by applying a high pressure thereon with a roll and subsequently crushed to granules having predominantly a size of between 5 and 10 mm.

The remaining 30% of the pipeline slurry was mechanically dewatered to a moisture content of 13% by weight by filtration.

The filter cake obtained was subsequently mixed with the above granules. Ultimately, the dry briquettes were added to the mixture and thoroughly mixed therewith. The wet load obtained in this way contained 1140 $kg/m^3$ coal under a load of 1 $kg/cm^2$.

What we claim is:

1. A method of transporting coal by ship, in which the ship is loaded with a wet load of coal prepared from an aqueous slurry of coal fines, the wet load of coal having less water than the slurry to economize transportation and being resistant to settling and compacting of the fines in the coal to facilitate removal of the wet load of coal from the ship, comprising preparing briquettes with a dry appearance containing less then 20% by weight of water from the aqueous slurry of coal fines and subsequently mixing the briquettes with a mass of water and coal fines, and loading the ship with the resulting wet load of coal.

2. The method of claim 1 in which the aqueous coal slurry has been withdrawn from a pipeline.

* * * * *